US006978603B2

(12) United States Patent
Asanuma

(10) Patent No.: US 6,978,603 B2
(45) Date of Patent: Dec. 27, 2005

(54) EXHAUST GAS CONTROL DEVICE-EQUIPPED INTERNAL COMBUSTION ENGINE AND EXHAUST GAS CONTROL METHOD

(75) Inventor: Takamitsu Asanuma, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/330,200

(22) Filed: Dec. 30, 2002

(65) Prior Publication Data

US 2003/0131593 A1 Jul. 17, 2003

(30) Foreign Application Priority Data

Jan. 16, 2002 (JP) ..... 2002-007682

(51) Int. Cl.[7] ..... F01N 3/00

(52) U.S. Cl. ..... 60/297; 60/274; 60/284; 60/285; 60/295; 55/DIG. 30

(58) Field of Search ..... 60/274, 275, 285, 60/295, 297, 311, 276, 284; 55/DIG. 30; 95/273, 276, 283; 422/169, 171, 177

(56) References Cited

U.S. PATENT DOCUMENTS

| | | | | |
|---|---|---|---|---|
| 5,746,984 | A * | 5/1998 | Hoard | 422/169 |
| 5,758,496 | A * | 6/1998 | Rao et al. | 60/297 |
| 6,090,187 | A * | 7/2000 | Kumagai | 60/311 |
| 6,167,696 | B1 * | 1/2001 | Maaseidvaag et al. | 60/311 |
| 6,233,927 | B1 * | 5/2001 | Hirota et al. | 60/297 |
| 6,412,276 | B1 * | 7/2002 | Salvat et al. | 60/295 |
| 6,479,023 | B1 * | 11/2002 | Evans et al. | 60/275 |
| 6,557,340 | B1 * | 5/2003 | Twigg et al. | 60/275 |
| 6,594,990 | B2 * | 7/2003 | Kuenstler et al. | 60/295 |
| 6,817,174 | B1 * | 11/2004 | Igarashi et al. | 60/295 |

FOREIGN PATENT DOCUMENTS

| | | |
|---|---|---|
| DE | 199 04 736 A1 | 8/2000 |
| DE | 697 03 680 T2 | 5/2001 |
| EP | 0 828 063 B1 | 12/2000 |
| JP | A-64-77718 | 3/1989 |
| JP | A 1-318715 | 12/1989 |
| JP | A-6-272541 | 9/1994 |
| JP | B2 7-106290 | 11/1995 |
| JP | A-11-125132 | 5/1999 |
| JP | A-2000-45843 | 2/2000 |
| JP | A-2000-303878 | 10/2000 |
| WO | WO 98/10177 | 3/1998 |

OTHER PUBLICATIONS

U.S. Appl. No. 10/088,476, filed Mar. 20, 2002, Hirota et al.

* cited by examiner

*Primary Examiner*—Tu M. Nguyen
(74) *Attorney, Agent, or Firm*—Oliff & Berridge PLC

(57) ABSTRACT

In an exhaust gas control device-equipped internal combustion engine, particulate matter produced in conjunction with combustion of gasoline in a combustion chamber is oxidized by an exhaust gas control device provided in an exhaust passage. The engine includes air-fuel ratio control changer that changes between a feedback control toward a stoichiometric air-fuel ratio whereby an amount of oxygen in exhaust gas is reduced and a feedback control toward a lean-burn combustion side whereby the amount of oxygen in exhaust gas is increased, if the oxidation speed of particulate matter in the exhaust gas control device provided in the exhaust passage is slow, or if the amount of deposit of particulate matter is great.

20 Claims, 11 Drawing Sheets

* SINCE FREQUENCY OF DETERMINING RICH INCREASES, LEAN CORRECTION TIME INCREASES, SO THAT SHIFT OCCURS TOWARD LEAN SIDE.

EXHAUST GAS CONTROL DEVICE-EQUIPPED INTERNAL COMBUSTION ENGINE AND EXHAUST GAS CONTROL METHOD

INCORPORATION BY REFERENCE

The disclosure of Japanese Patent Application No. 2002-7682 filed on Jan. 16, 2002, including its specification, drawings and abstract, is incorporated herein by reference in its entirety.

BACKGROUND OF THE INVENTION

1. Field of the Invention

The invention relates to a control of particulate matters produced from an internal combustion engine and, more particularly, from a gasoline engine.

2. Description of the Related Art

Particulate matter in engine exhaust gas, including small particles of soot, and the like, is typically a problem in diesel engines. Various technologies for removing particulate matter from diesel engine exhaust gas have been developed. Such a technology is disclosed in, for example, Japanese Examined Patent Application Publication No. 7-106290.

However, particulate matter is produced not only from diesel engines, but also from gasoline engines. In particular, direct-injection type gasoline engines are apt to produce smoke due to excessively high fuel concentration near ignition plugs during a stratified lean combustion mode in which a small amount of fuel provided in a stratified state in combustion chambers is burned. Therefore, there is a strong demand for appropriate removal of particulate matter present in the smoke. Since gasoline engines differ from diesel engines in fuel, and also in engine operating conditions due to the fuel difference, it is necessary to consider removal of particulate matter specifically for gasoline engines.

SUMMARY OF THE INVENTION

It is an object of the invention to perform more efficient removal of particulate matter produced by a gasoline engine.

The invention adopts the below-described means in an internal combustion engine in which particulate matter produced in conjunction with combustion of gasoline in a combustion chamber is subjected to an oxidizing treatment by an exhaust gas control device provided in an exhaust passage.

Basically, if an operation condition where an oxidation speed of particulate matter decreases is assumed, or if an amount of particulate matter deposited is at least a predetermined amount, an air-fuel ratio is shifted to a leaner side from the present air-fuel ratio by an air-fuel ratio controller, so as to increase the supply of oxygen.

To this end, various means are conceivable.

In this invention, in a stoichiometric engine (a port injection type stoichiometric engine, or a direct-injection type stoichiometric engine) capable of operating at the stoichiometric air-fuel ratio, for example, an air-fuel ratio control changer is provided for changing between a feedback control toward the stoichiometric air-fuel ratio whereby the amount of oxygen in exhaust gas is reduced and a feedback control toward a lean-burn combustion side whereby the amount of oxygen in exhaust gas is increased, in accordance with a state of particulate matter in the exhaust gas control device provided in the exhaust passage.

In this construction, it is desirable for the internal combustion engine to have a feedback controller for feedback-controlling the air-fuel ratio to a predetermined target value based on an output of an oxygen concentration sensor provided in the exhaust passage.

The internal combustion engine may include a first air-fuel ratio controller for performing a stoichiometric feedback control with the target value being set at a stoichiometric air-fuel ratio, and a second air-fuel ratio controller for performing a lean feedback control in which an amount of fuel is made small relatively to the stoichiometric air-fuel ratio, wherein in principle, the control by the first air-fuel ratio controller is performed, and the controller is changed to the second air-fuel ratio controller in accordance with a state of particulate matter in the exhaust gas control device.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the invention will be described hereinafter with reference to the accompanying drawings.

<Embodiment of Exhaust Gas Control Device-Equipped Internal Combustion Engine>

First, a gasoline engine that is an internal combustion engine to which the invention is applied will be described.

Figure 1:
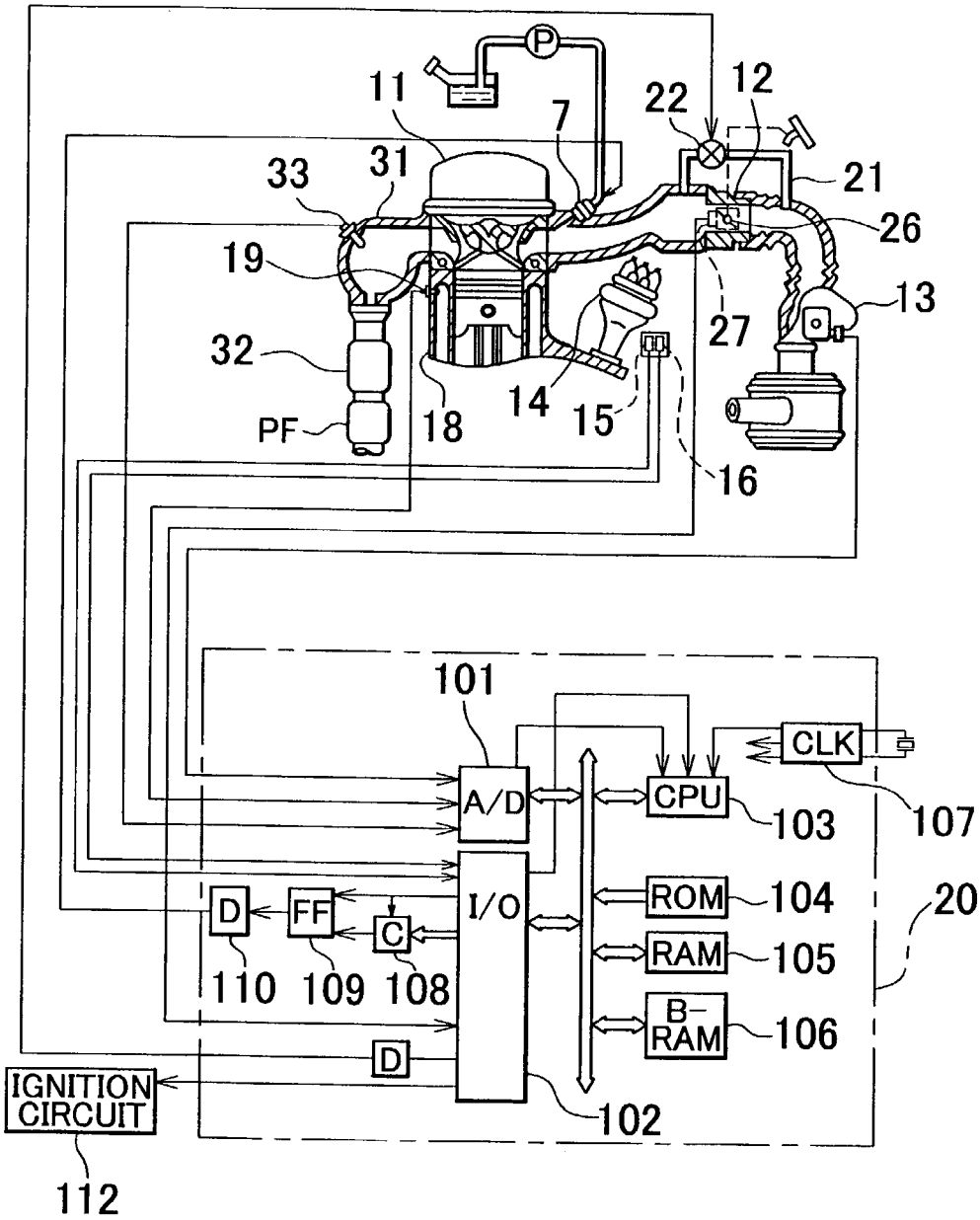
FIG. 1 is a schematic diagram illustrating a hardware construction of an embodiment of the invention.

FIG. 1 is a schematic diagram illustrating an overall construction of an exhaust gas control device-equipped gasoline engine. FIG. 1 shows an internal combustion engine body 1, an intake passage 12, and an air flow meter 13 provided in the intake passage 12. The air flow meter 13 directly measures the amount of flow of intake air. The air flow meter 13 employed in this embodiment is, for example, a movable vane-type air flow meter with a built-in potentiometer, and generates an output signal of analog voltage proportional to the amount of flow of intake air. The output signal of the air flow meter 13 is input to a multiplexer-equipped A/D converter 101 provided in a control circuit 20. A distributor 14 is provided with a crank angle sensor 15 that generates a reference position detection-purposed pulse signal at every 720° in terms of crank angle, and a crank angle sensor 16 that generates a crank angle detection-purposed pulse signal at every 30° in crank angle. The pulse signals from the crank angle sensors 15, 16 are supplied to an input-output interface 102. The output of the crank angle sensor 16 is supplied to an interrupt terminal of a CPU 103.

Furthermore, the intake passage 12 is provided with fuel injection valves 7 for supplying pressurized fuel from a fuel supply system to intake ports of individual cylinders. A throttle valve 26 of the intake passage 12 is provided with an idle switch 27 that generates a signal indicating whether the throttle valve 26 is in a completely closed state, that is, an LL signal. The idle state output signal LL is supplied to the input-output interface 102 of the control circuit 20.

In this embodiment, the intake passage 12 has a bypass passage 21 that bypasses the throttle valve 26, and an idle speed control valve (ISC valve) 22 that controls the amount of flow of air through the bypass passage 21. The ISC valve 22 is a flow control valve that is driven by an appropriate type of actuator, for example, a stepper motor or the like. The ISC valve 22 operates upon an output signal of the control circuit 20. The ISC valve 22 is used to control the idle speed of the engine to a target rotation speed by adjusting the amount of air taken into the engine during an idle operation. In this embodiment, the ISC valve 22 functions as a part of catalyst heating means for raising the temperature of a catalyst by increasing the engine idle speed and therefore increasing the amount of flow of exhaust if the catalyst has not been activated.

A water jacket 18 of a cylinder block of the engine body 11 is provided with a water temperature sensor 19 for detecting the temperature of cooling water. The water temperature sensor 19 generates an electric signal of analog voltage corresponding to the temperature of cooling water. The output of the water temperature sensor 19 is also supplied to the A/D converter 101.

Provided in an exhaust system downstream of an exhaust manifold 31 of the engine body 11 is a catalytic converter 32 that contains a three-way catalyst for simultaneous removal of three harmful components of exhaust gas, that is, HC, CO and NOx. The exhaust manifold 31 located upstream of the catalytic converter 32 is provided with an air-fuel ratio sensor (in this embodiment, an $O_2$ sensor that detects the oxygen concentration) 33.

The $O_2$ sensor 33 detects the concentration of an oxygen component in exhaust gas, and generates an output voltage that varies depending on whether the air-fuel ratio is on the rich or lean side of the stoichiometric air-fuel ratio. The output voltage of the $O_2$ sensor 33 is supplied to the A/D converter 101 of the control circuit 20.

The control circuit 20 is formed as, for example, a microcomputer, and has a ROM 104, a RAM 105, a backup RAM 106, a clock generating circuit 107, etc., besides the A/D converter 101, the input-output interface 102 and the CPU 103.

In this embodiment, the control circuit 20 performs basic controls, such as the fuel injection control of the engine body 11, the ignition control, etc. Furthermore, the control circuit 20 realizes various functional means of the invention, such as air-fuel ratio control means for controlling the engine air-fuel ratio, catalyst activation state detection means for detecting whether the catalyst 32 is in an activated state, catalyst activation means for performing catalyst warm-up by controlling the ISC valve 22 and retarding the engine ignition timing, air-fuel ratio changing means, deposit state detection means for detecting the state of deposit of particulate matter, etc., via programs.

The control circuit 20 further includes a down-counter 108, a flip-flop 109 and a drive circuit 110 that operate for controlling the fuel injection valve 7. That is, when a fuel injection amount (injection duration) TAU is computed in a routine described below, the injection duration TAU is pre-set in the down-counter 108, and the flip-flop 109 is set. As a result, the drive circuit 110 starts to energize the fuel injection valve 7. If the down-counter 108 counts clock signals (not indicated in the drawings) so that the output terminal of the down-counter 108 finally reaches a "1" level, the flip-flop 109 is set to stop the energization of the fuel injection valve 7. That is, the fuel injection valve 7 is energized for the fuel injection duration TAU, and therefore, an amount of fuel corresponding to the duration TAU is supplied to a corresponding combustion chamber of the engine body 11.

The input-output interface 102 of the control circuit 20 is connected to an ignition circuit 112, so as to control the ignition timing of the engine body 11. That is, after input of the reference crank angle pulse signal from the crank angle sensor 16 to the input-output interface 102, the control circuit 20 outputs an ignition signal to the ignition circuit 112 every time the crank angle reaches a predetermined rotation angle. In this manner, the control circuit 20 causes the ignition plugs (not shown) of the individual cylinders to produce sparks. As for the ignition timing of the engine body 11, optimal values are pre-stored in the ROM 104 of the control circuit 20 in the form of a function of engine operating conditions, such as the load (e.g., the amount of intake air per revolution of the engine), the engine rotation speed, etc., and an optimal ignition timing is determined in accordance with the operating conditions.

Cooling water temperature data and intake air amount data from the air flow meter 13 are input, and stored into predetermined areas in the RAM 105 by an A/D conversion routine executed at every predetermined time or every predetermined crank angle. That is, the intake air amount data and the cooling water temperature data in the RAM 105 are updated at every predetermined time. Rotation speed data is computed, and is stored into a predetermined area in the RAM 105, by an interrupt at every 30° CA (crank angle) based on the crank angle sensor 16.

Although this embodiment has been described in conjunction with a port-injection type gasoline engine in which fuel is injected from the fuel injection valves 7 to the intake ports, the gasoline engine may be a direct-injection type gasoline engine in which fuel injection valves are provided in a cylinder head so as to inject fuel directly into the cylinders.

<Three-Way Catalyst: Filter>

The three-way catalyst contained within the catalytic converter 32 is formed by depositing a thin layer of noble metals, such as platinum (Pt)+rhodium (Rh), or platinum (Pt)+rhodium (Rh)+palladium (Pd), etc., on surfaces of alumina. The catalyst simultaneously lessens three compo nents of exhaust gas, that is, CO, HC and NOx, through the following reactions:

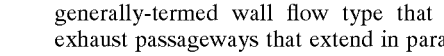

$$(O_2, NOx)+(CO, HC, H_2)\rightarrow N_2+H_2O+CO_2$$

In addition to the three-way catalyst, a particulate filter (PF) may be provided as an exhaust gas control device downstream of the three-way catalyst.

The particulate filter (PF) has a honeycomb structure of a generally-termed wall flow type that has a plurality of exhaust passageways that extend in parallel to one another. The particulate filter is formed from, for example, a porous material such as cordierite or the like. On internal walls of pores, a layer of a support of, for example, alumina, is formed. Supported on the support are a noble metal catalyst, and an active oxygen releaser agent that takes up and stores oxygen if excess oxygen is present near the agent, and that releases stored oxygen in the form of active oxygen if the oxygen concentration near the agent becomes lower.

As exhaust gas control device, a filter may be used which is formed by supporting a NOx absorber (active oxygen releaser) on a filter that is capable of oxidizing and removing particulate matter. In this filter, a support of, for example, alumina, is loaded with a noble metal, such as platinum Pt or the like, and at least one element selected from alkali metals, such as potassium K, sodium Na, lithium Li, cesium Cs, etc., alkaline earths, such as barium Ba, calcium Ca, etc., and rare earths, such as lanthanum La, yttrium Y, etc. Where the ratio between air and fuel supplied into the exhaust passage upstream of the NOx catalyst and the engine intake passage is termed air-fuel ratio of inflow exhaust gas that flows into the NOx catalyst, this NOx catalyst absorbs NOx when the air-fuel ratio of inflow exhaust gas is lean of stoichiometry, and releases stored NOx when the oxygen concentration in inflow exhaust gas becomes low.

Furthermore, as an exhaust gas control device, a filter loaded with an oxidation catalyst may be used. The oxidation catalyst is formed by, for example, loading surfaces of granular alumina generally termed catalyst pellets, with a noble metal thin layer of, for example, palladium (Pd), palladium+platinum (Pt), etc. The oxidation catalyst facilitates oxidation of CO and HC present in exhaust gas into $CO_2$ and $H_2O$, which are innoxious.

Also used as an exhaust gas control device may be a combination of a filter that does not carry a catalyst thereon, and a catalyst for oxidation of NO into $NO_2$ which is disposed upstream of the filter. In this exhaust gas control device, $NO_2$ is used to oxidize particulate matter.

<Fuel Injection Control>

Below described will be a fuel injection control in the embodiment of the invention constructed as described above. This control is executed by the control circuit 20.

The state where exhaust gas control performance of the three-way catalyst can be expected is limited to a narrow range of air-fuel ratio near the stoichiometric air-fuel ratio. Therefore, it is essential that the amount of fuel injected be controlled to an amount that achieves complete combustion with the amount of oxygen taken in (the air-fuel ratio in this situation is the stoichiometric air-fuel ratio).

However, if the air-fuel ratio is controlled to the stoichiometric air-fuel ratio, problems arise in running performance, engine safety, fuel economy, etc. in some cases. Therefore, it is necessary to perform various corrections. To that end, the fuel injection control is needed.

The aforementioned lean-burn control is accomplished also through the fuel injection control.

The fuel injection control is realized by the CPU 103 controlling the drive time of the drive circuit 110 of the fuel injection valves 7 (fuel injection duration TAU=fuel injection amount).

The injection duration TAU (=fuel injection amount) varies between the time of engine startup and the time of engine operation after warm-up. It should be noted that in the description below, the injection duration and the fuel injection amount mean the same.

The fuel injection amount at the time of startup can be determined by, for example, the following manner.

If an engine startup fuel injection valve is provided in addition to a main fuel injection valve, fuel is continuously injected via the startup fuel injection valve for a predetermined time (determined by the water temperature) at the time of engine startup through an open loop control. The injection is stopped when the engine rotation speed reaches or exceeds a predetermined value.

On the other hand, in the case of the main fuel injection valves, the fuel injection duration TAU (fuel injection amount) is determined by the following equation:

$$TAU=TAUSTU\times FTHA+TAUV$$

TAUSTU: the startup basic injection duration (injection amount) that is determined by the temperature of cooling water and that increases with decreases in the water temperature.

FTHA: an intake temperature correction value that is decreased with increases in the intake air temperature because the air density varies with the intake air temperature.

TAUV: the invalid injection duration. The fuel injection valve has an actuation delay between application of a drive voltage thereto and the opening of the valve, and also has a delay in closing. The delay time is longer at the time of opening the valve than at the time of closing the valve. Therefore, if a simple attempt is performed to apply a driving voltage to the fuel injection valve for a duration corresponding to the amount of fuel that actually needs to be taken into the cylinder, the actual open valve duration becomes shorter than intended (the actual injection amount is less than intended). The duration during which fuel injection from the fuel injection valve is not performed is termed invalid injection duration. The invalid injection duration TAUV is a correction amount for correcting the fuel injection duration so that the amount of fuel actually injected will equal a required value.

Fuel injection amount (duration) after startup

After startup, the engine is operated based on the fuel injection amount determined by the following equation:

$$TAU=TAUP\times FWL\times(FAF+FG)\times\{FASE+FAE+FOTP+FDE(D)\}\times FFC+TAUV$$

TAUP: the basic injection amount (injection duration), that is, a basic value of fuel injection amount determined based on the amount of air taken in by a single intake stroke (which is determined from a sensor-detected value).

FWL: the warm-up increase. Since during warm-up, a fuel-rich air-fuel ratio is needed due to poor atomization of fuel, an increasing correction of the amount of fuel is performed to shift the air-fuel ratio to the rich side during warm-up. The warm-up increase is obtained by correcting a correction value that corresponds to the cooling water temperature by a correction factor based on the engine rotation speed.

FAF: the air-fuel ratio feedback correction factor. In order to control the air-fuel ratio to a range (near the stoichiometric air-fuel ratio) where good exhaust gas control efficiency of the three-way catalyst is expected, the present air-fuel ratio is detected from the output value of the oxygen sensor, and the air-fuel ratio is feedback-controlled so as to enter the aforementioned range.

FG: the air-fuel ratio learning factor. The needed amount of fuel injection varies depending on individual differences of engines and changes over time even under the same operating conditions. During the air-fuel ratio feedback, the difference between the actually needed value and the calculated value is corrected by the feedback. However, when the feedback is not performed, the difference directly appears, and therefore the air-fuel ratio deviates. Therefore, the amount of correction made by the feedback is stored in memory, and is always corrected, so as to eliminate the aforementioned difference in all engine operation states.

FASE: the post-startup increase. Immediately after startup, the ports and their surroundings are dry. In order to wet the port regions and therefore prevent engine stall, the fuel injection amount is increased for a predetermined time after startup. The initial value of FASE is determined based on the cooling water temperature occurring at the time of startup. After that, the value of FASE is reduced at every predetermined fuel injection. The reduction of FASE is ended when FASE=0 is reached.

FAE: the acceleration increase. At the time of acceleration, the intake pipe pressure rises (negative pressure decreases), so that, of the amount of fuel injected, the amount of fuel deposited on the intake valves and their surroundings increases. A certain time is required before the deposited fuel enter the combustion chambers. Therefore, during acceleration, the air-fuel ratio becomes lean of stoichiometry unless the fuel injection amount is increased by an amount corresponding to the increase in the amount of deposit of fuel. The acceleration increase FAE compensates for the increase in the amount of deposit of fuel.

FOTP: the OTP increase. At the time of high-load or high-speed operation, the exhaust gas temperature becomes high so that there arises a danger of heat damage to component parts of the exhaust system. Therefore, the air-fuel ratio is shifted to the rich side of the stoichiometric air-fuel ratio to reduce the exhaust temperature.

FDE(D): the deceleration increase (decrease). At the time of deceleration, the air flow meter outputs a detection value that is smaller than the actual value due to undershoot. In order to compensate for the reduced value, an increase is provided at the time of deceleration. Furthermore, at the time of deceleration, the intake pipe negative pressure grows, so that the fuel deposited on the intake pipe evaporates and is taken into the combustion chambers. In order to compensate for that amount of fuel taken in, the fuel injection amount is decreased.

FFC: the fuel-cut discontinuation-time correction factor. In some cases, fuel-cut is performed to improve fuel economy. In order to prevent a shock caused by a sharp increase in torque at the time of discontinuation of fuel-cut, the fuel injection amount is reduced for a smooth torque rise at the time of discontinuation of fuel-cut.

TAUV: the invalid injection time.

To facilitate understanding, the aforementioned equation is simplified to $TAU=TAUP\times FAF\times\beta+\gamma$.

Figure 2:
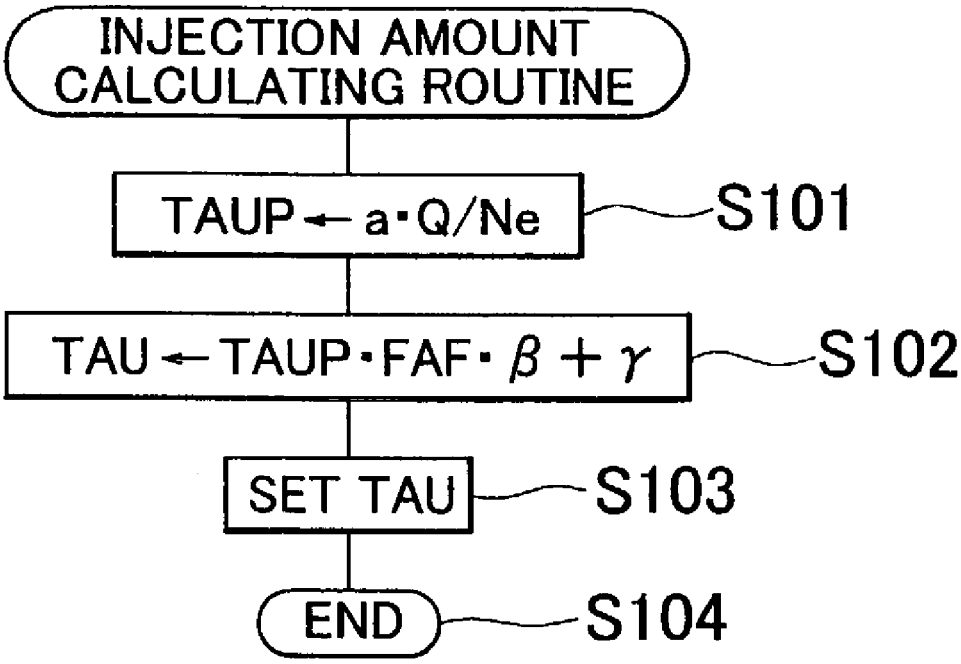
FIG. 2 is a flowchart illustrating computation of the amount of fuel injected.

FIG. 2 illustrates a routine of computing a fuel injection amount through the use of the equation. This routine is executed at every predetermined crank angle, for example, 360°. In step S101, intake air amount data Q and rotation speed data Ne are read from the RAM 105, and a basic fuel injection amount TAUP (TAUP is the fuel injection duration for achieving the stoichiometric air-fuel ratio) is computed. For example, the computation is performed as in $TAUP\leftarrow\alpha\cdot Q/Ne$ ($\alpha$ is a constant). In step S102, a final fuel injection amount TAU is computed as in $TAU\leftarrow TAUP\cdot FAF\cdot\beta+\gamma$. Subsequently in step S103, the injection-amount TAU is set in the down-counter 108, and the flip-flop 109 is set, so as to start fuel injection. Subsequently in step S104, this routine ends. As described above, when the time corresponding to the fuel injection amount TAU elapses, the flip-flop 109 is reset by the output signal of the down-counter 108, so that the fuel injection ends.

In the above-described manner, the fuel injection amount is determined, and fuel injection is performed based on the fuel injection amount. As a result, the air-fuel ratio is determined. That is, the air-fuel ratio control is accomplished.

<Air-Fuel Ratio Feedback Control>

Due to the air-fuel ratio feedback control performed in the fuel injection control, the air-fuel ratio control in accordance with the invention is accomplished.

This control is performed by first air-fuel ratio control means that is realized on the CUP of the control circuit 20 by a program. The first air-fuel ratio control means is stoichiometric feedback control means for feedback-controlling a target value toward the stoichiometric air-fuel ratio. If the output value of the $O_2$ sensor provided in the exhaust passage is rich of stoichiometry (high concentration with reference to the stoichiometric air-fuel ratio), the fuel injection amount is reduced. If the output value of the $O_2$ sensor is lean of stoichiometry (low concentration with reference to the stoichiometric air-fuel ratio), the fuel injection amount is increased.

Second air-fuel ratio control means is realized on the CPU of the control circuit 20 by a program. The second air-fuel ratio control means is lean feedback control means for shifting the air-fuel ratio to a leaner air-fuel ratio.

Figure 3:
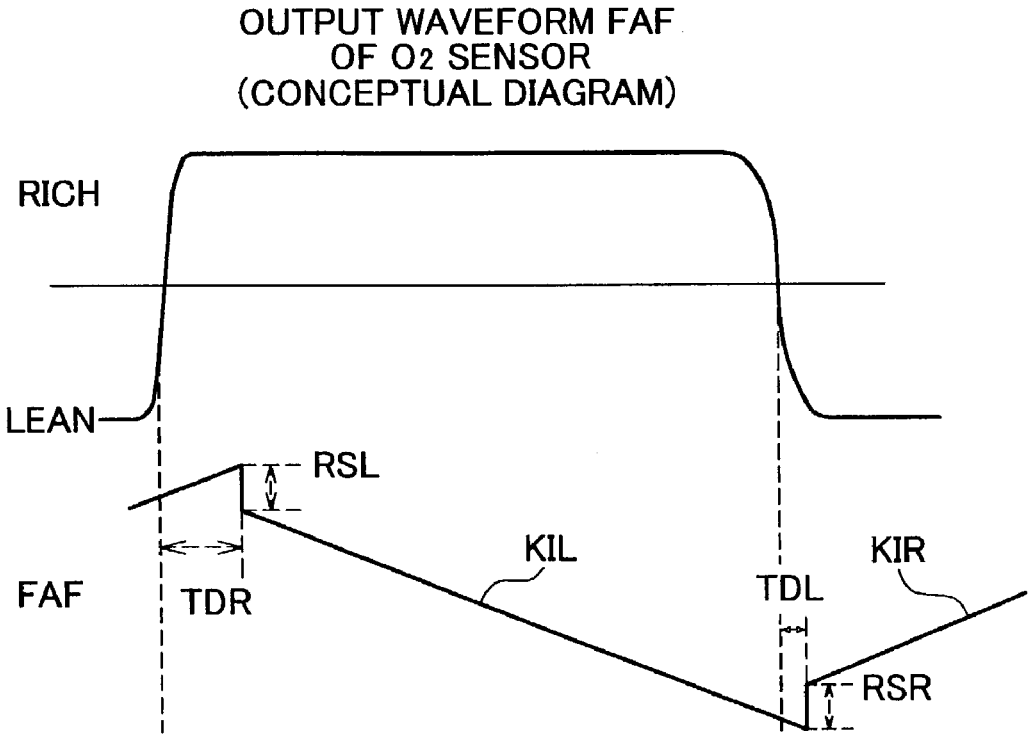
FIG. 3 is a conceptual diagram indicating a relationship between the output waveform of an $O_2$ sensor and an air-fuel ratio correction factor FAF.

FIG. 3 indicates a relationship between the value of FAF and the output waveform of the $O_2$ sensor used in the feedback control. In FIG. 3, TDR and TDL are inverse-characteristic delay time settings for compensating for the response delay of the $O_2$ sensor occurring at the time of transition from the lean side to the rich side and transition from the rich side to the lean side. The responsiveness of the $O_2$ sensor is better in the lean-to-rich transition than in the rich-to-lean transition. In the transition from the rich side to the lean side, excess $O_2$ arrives in a state where only a small amount of oxygen exists around the sensor detection portion. Conversely, in the transition from the lean side to the rich side, $O_2$ present in excess reacts with arriving HC and CO, so that the amount of $O_2$ reduces. Since $O_2$ has a greater molecular size than HC and CO, $O_2$ needs a longer time to reach the detection portion of the sensor than HC and CO. Therefore, the time needed before the $O_2$ sensor becomes able to detect the switching of the air-fuel ratio varies between the two directions of transition as described above.

During the detection delay time in the lean-to-rich transition (rich detection delay), the $O_2$ sensor produces a "lean" output although the actual air-fuel ratio is rich of stoichiometry. Therefore, the feedback control performs a correction to a richer side, so that the actual air-fuel ratio becomes further rich of stoichiometry. During the detection delay time in the rich-to-lean transition (lean detection delay), the $O_2$ sensor produces a "rich" output although the actual air-fuel ratio is lean of stoichiometry. Therefore, the feedback control performs a correction to a leaner side, so that the actual air-fuel ratio becomes further lean of stoichiometry. In an overall view, since the lean detection delay is longer than the rich detection delay, the excessive correction to a leaner side continues for a longer time than the excessive correction to a richer side, that is, a lean deviation occurs. In order to prevent this problem, the delay times TD (TDR>TDL) having inverse characteristics with respect to the aforementioned delay times are set.

In FIG. 3, RSL and RSR are the fuel injection amounts that are corrected stepwise at the times of the rich-to-lean transition and the lean-to-rich transition. RSL is termed lean skip constant, and RSR is termed rich skip constant.

Also in FIG. 3, KIL and KIR represent gradients (integration constants) of gradual correction of the fuel injection amount to the lean (rich) side during the rich (lean) state.

The above-described apparatus is able to compute the air-fuel ratio correction factor FAF based on the output of the $O_2$ sensor 33 by the first air-fuel ratio control means, and therefore is able to feedback-control the air-fuel ratio toward the stoichiometric air-fuel ratio.

Figure 4:
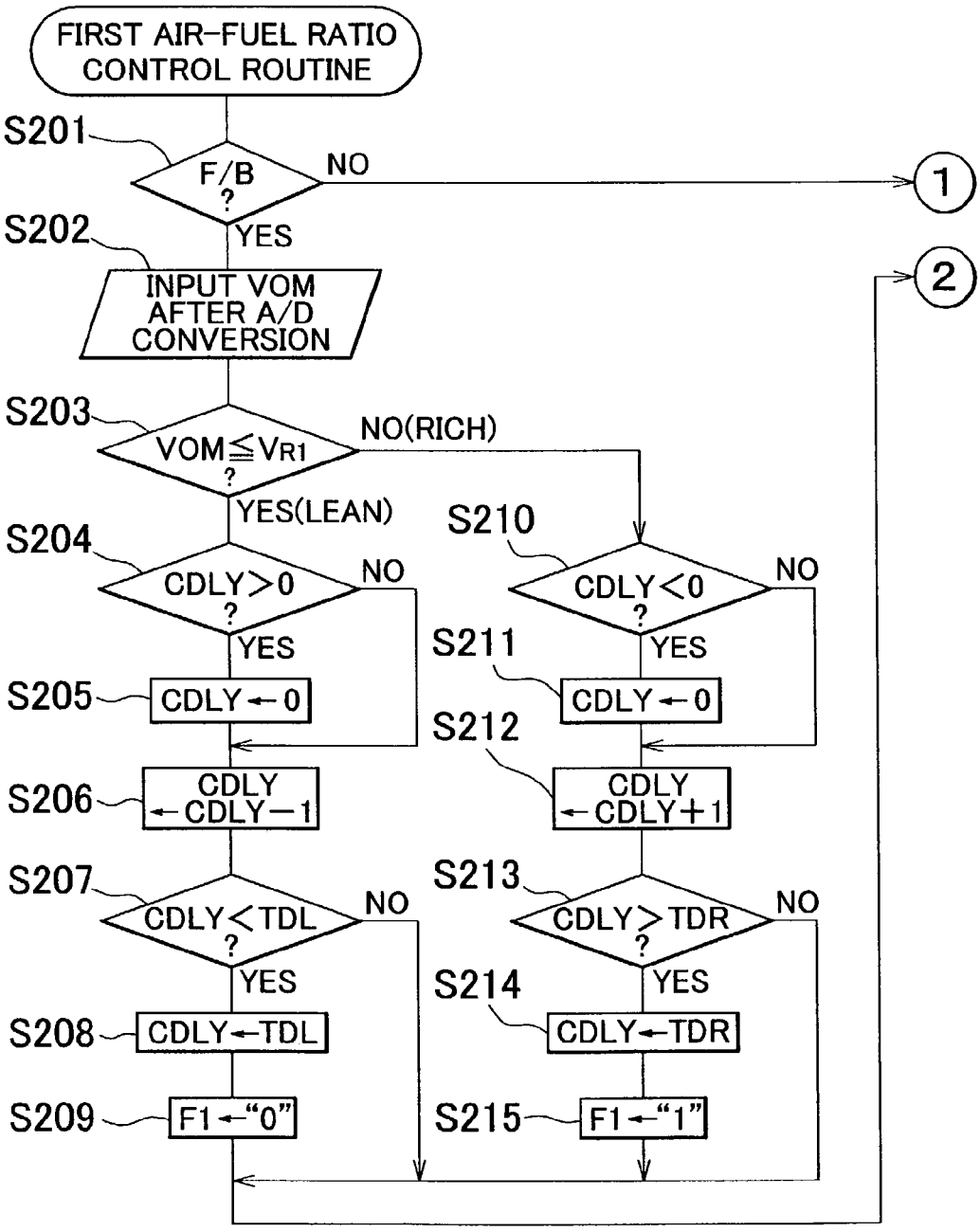
FIG. 4 is a part of a flowchart illustrating an air-fuel ratio control based on the output of the $O_2$ sensor.
Figure 5:
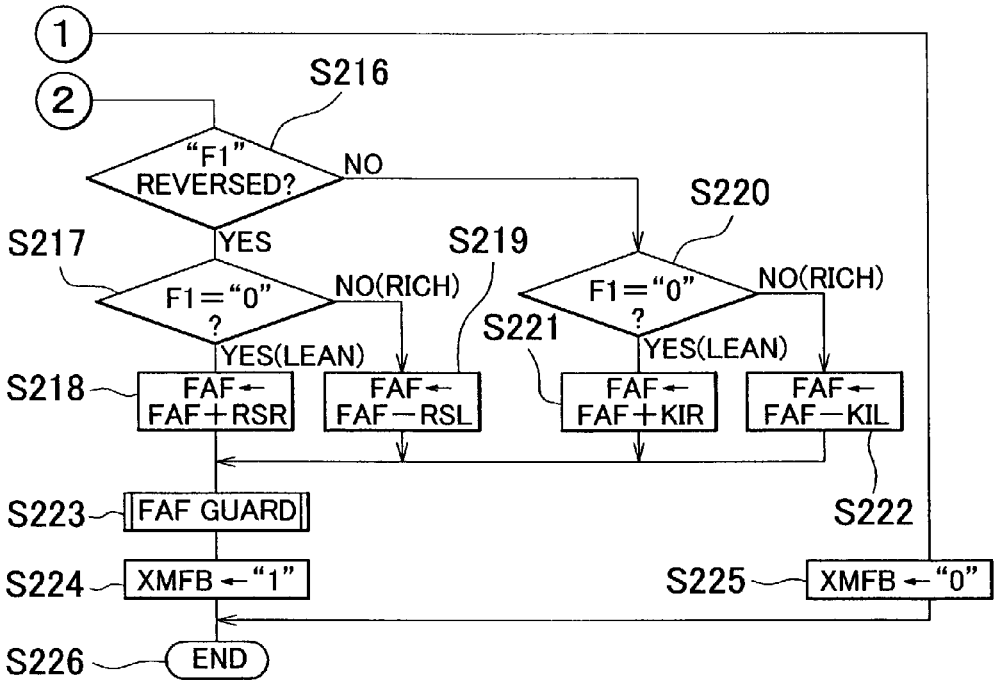
FIG. 5 is another part of the flowchart illustrating the air-fuel ratio control based on the output of the $O_2$ sensor.

FIGS. 4 and 5 illustrate an air-fuel ratio control routine of computing an air-fuel ratio correction factor FAF. This routine is executed at every predetermined time, for example, 4 ms. In step S201, it is determined whether a closed loop (feedback) condition for the air-fuel ratio by the $O_2$ sensor 33 is met. The closed loop condition is not met, for example, if the cooling water temperature is lower than or equal to a predetermined value (e.g., 70° C.), or if the engine startup is being performed, or if the post-startup increase is being performed, or if the warm-up increase is being performed, or if the power increase is being performed, or if the fuel injection amount increase for preventing overheating of the catalyst is being performed, or if the output signal of the upstream-side $O_2$ sensor 33 has not been inverted, or if the fuel-cut is being performed, etc. In other cases, the closed loop condition is met. If the closed loop condition is not met, the process proceeds to step S225 in FIG. 5, in which the air-fuel ratio feedback flag XMFB is set to "0". Subsequently in step S226, the routine ends. The air-fuel ratio correction factor FAF may be set at "1.0". If the closed loop condition is met, the process proceeds to step S202.

In step S202, the output VOM of the $O_2$ sensor 33 is input after the A/D conversion thereof. Subsequently in step S203, it is determined whether the air-fuel ratio is lean or rich of stoichiometry on the basis of whether VOM is lower than or equal to a comparison voltage VR1. The comparison voltage VR1 is normally a voltage at the center of amplitude of the output of the $O_2$ sensor. In this embodiment, VR1=0.45 V. Steps S204 to S204 and steps S210 to S215 are procedures of setting an air-fuel ratio flag F1 based on the value of output of the $O_2$ sensor 33 determined in step S203.

The air-fuel ratio flag F1 indicates whether the air-fuel ratio of exhaust gas upstream of the catalyst 32 is rich or lean of stoichiometry. The value of flag F1 is changed from 1 (rich) to 0 (lean) or from 0 to 1 (steps S207 to S209, and steps S213 to S215) by the count-down operation (in the case of lean air-fuel ratio) or the count-up operation (in the case of rich air-fuel ratio) of a delay counter CDLY (steps S206 and S212), when the output of the upstream-side $O_2$ sensor 33 remains rich or lean of stoichiometry for at least a predetermined delay time (TDL, TDR). The value TDL (steps S207 and S208) is a lean delay time for retaining the determination of a rich state despite the changing of the output of the $O_2$ sensor 33 from the rich side to the lean side, and is defined as a negative value. The value TDR (steps S213 and S214) is a rich delay time for retaining the determination of a rich state despite the changing of the output of the $O_2$ sensor 33 from the lean side to the rich side, and is defined as a positive value.

Subsequently in step S216, it is determined whether the sign of the value of the air-fuel ratio flag F1 has reversed, that is, whether the air-fuel ratio after the delay process has reversed. If the, air-fuel ratio has reversed, it is determined in step S217 whether the reverse is from rich to lean or from lean to rich based on the value of the air-fuel ratio flag F1. If the reverse is from rich to lean, the air-fuel ratio correction factor FAF is increased in a skip manner of FAF←FAF+RSR to correct the air-fuel ratio to a richer side in step S218. Conversely, if the reverse is from lean to rich, the air-fuel ratio correction factor FAF is decreased in a skip manner of FAF←FAF−RSL to correct the air-fuel ratio to a leaner side in step S219. That is, a skip process is performed.

If it is determined in step S216 that the sign of the air-fuel ratio flag F1 has not reversed, an integration process is performed in steps S220, S221 and S222. That is, in step S220, it is determined whether F1="1". If F1="0" (lean), FAF←FAF+KIR is performed instep S221. Conversely, if F1="1" (rich), FAF←FAF−KIL is performed in step S222. The integration constants KIR, KIL are pre-set sufficiently small in comparison with the skip constants RSR, RSL, that is, KIR (KIL)<RSR (RSL). Therefore, in step S221, the air-fuel ratio is gradually changed from a lean state (F1="0") toward a rich side. In step S222, the air-fuel ratio is gradually changed from a rich state (F1="1") toward a lean side.

Subsequently in step S223, the air-fuel ratio correction factor FAF is computed in steps S218, S219, S221 and S222 is guarded by a minimum value, for example, 0.8, or by a maximum value, for example, 1.2. Therefore, if the air-fuel ratio correction factor FAF becomes excessively great or excessively small from any cause, the air-fuel ratio of the engine is controlled by the guard value to prevent an over-rich or over-lean state. In step S224, the air-fuel ratio feedback flag XMFB is set to "1", and the value FAF calculated as described above is stored into the RAM 105. Subsequently in step S226, this loop ends.

Figures 6A, 6B, 6C, 6D:
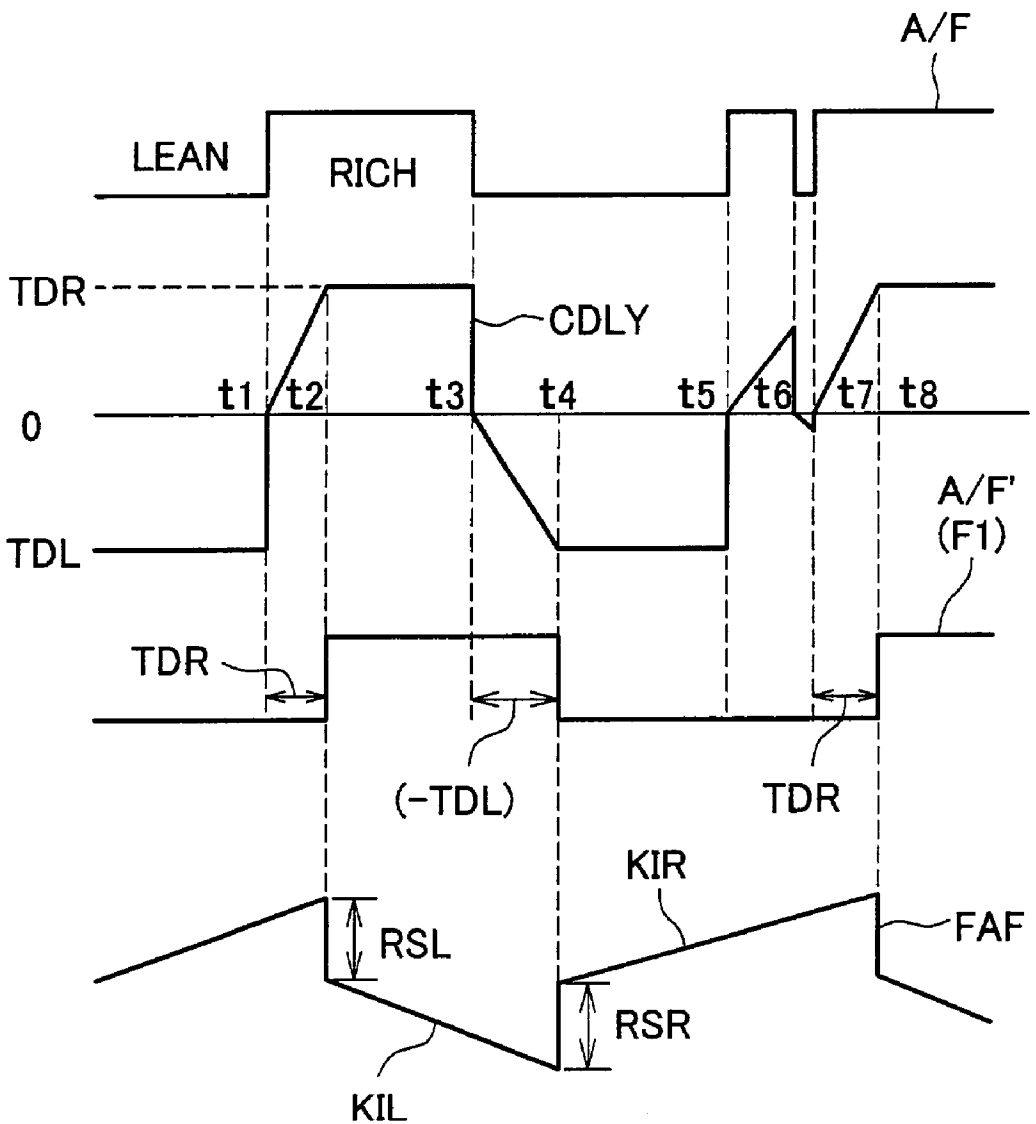
FIGS. 6A to 6D are time charts for additional illustration of the flowchart of FIGS. 4 and 5.

The above-described procedure is illustrated in timing charts of FIGS. 6A to 6D. When a rich/lean determination air-fuel ratio signal A/F is obtained from the output VOM of the $O_2$ sensor 33 as indicated in FIG. 6A, the delay counter CDLY counts up in the case of the rich state, or counts down in the case of the lean state, as indicated in FIG. 6B. As a result, a delay-processed air-fuel ratio signal A/F' (corresponding to the air-fuel ratio flag F1) is formed as indicated in FIG. 6C. For example, although the air-fuel ratio signal A/F changes from the lean to rich side at a time point t1, the delayed air-fuel ratio signal A/F' is held on the lean side for the rich delay time TDR, and changes to the rich side at a time point t2. Although the air-fuel ratio signal A/F changes from the rich to lean side at a time point t3, the delayed air-fuel ratio signal A/F' is held on the rich side for a time corresponding to the lean delay time (−TDL), and changes to the lean side at a time point t4.

However, if the air-fuel ratio signal A/F reverses in a time shorter than the rich delay time TDR as in the case of time points t5, t6 and t7, a long time is needed for the delay counter CDLY to reach the maximum value TDR. As a result, the delayed air-fuel ratio signal A/F' reverses at a time point t8. That is, the post-delay process air-fuel ratio signal A/F' is more stable than the pre-delay process air-fuel ratio signal A/F. On the basis of the stable air-fuel ratio signal A/F' provided by the delay process, the air-fuel ratio correction factor FAF is obtained as indicated in FIG. 6D.

<Control of the Invention>

In the invention, the air-fuel ratio control changing means is used to change between the feedback control to the stoichiometric air-fuel ratio whereby the amount of oxygen in exhaust gas is reduced (first air-fuel ratio control means) and the feedback control to a lean-burn combustion side whereby the amount of oxygen in exhaust gas is increased (second air-fuel ratio control means), in accordance with the state of oxidation or the state of deposit of particulate matter at the exhaust gas control device provided in the exhaust passage.

The embodiment comprises first air-fuel ratio control means for performing a stoichiometric feedback control in which the air-fuel ratio is brought to the stoichiometric air-fuel ratio based on the output of the $O_2$ sensor, and second air-fuel ratio control means for performing a lean feedback control in which the amount of fuel is changed to an excess lean state relative to the stoichiometric air-fuel ratio. In principle, the control by the first air-fuel ratio control means is performed. If it is determined that particulate matter has deposited on the exhaust gas control device, or if a condition where the rate of oxidation of particulate matter decreases is established, the air-fuel ratio control means is switched to the second air-fuel ratio control means. That is, the stoichiometric operation is performed in principle. If it is determined that particulate matter has deposited, or if it is determined that the oxidation speed is about to decrease, the control is switched to the lean side.

Examples of specific procedures for the aforementioned control include a procedure in which in the air-fuel ratio control, an air-fuel ratio correction factor FAF2 is set so that the air-fuel ratio shifts to the lean side, and a procedure in which air-fuel ratio control constants, such as the skip constants RSR, RSL, the integration constants KIR, KIL, the delay times TDR, TDL, or the comparison voltage (lean/rich determination voltage) VR1 for the output VOM of the air flow meter 13, are made variable.

Next described will be how the air-fuel ratio changes if air-fuel ratio constant values are variable. For example, if the rich skip constant RSR is increased, the control air-fuel ratio can be shifted to the rich side. Furthermore, reduction of the lean skip constant RSL allows a shift of the control air-fuel ratio to the rich side. In contrast, increase of the lean skip constant RSL allows a shift of the control air-fuel ratio to the lean side. Reduction of the rich skip constant RSR allows a shift of the control air-fuel ratio to the lean side.

Furthermore, increase of the rich integration constant KIR allows a shift of the control air-fuel ratio to the rich side. Reduction of the lean integration constant KIL also allows a shift of the control air-fuel ratio to the rich side. In contrast, increase of the lean integration constant KIL allows a shift of the control air-fuel ratio to the lean side. Reduction of the rich integration constant KIR also allows a shift of the control air-fuel ratio to the lean side. Therefore, the air-fuel ratio can be controlled by correcting the rich integration constant KIR and the lean integration constant KIL.

If the rich delay time TDR is set larger or the lean delay time (−TDL) is set smaller, the control air-fuel ratio can be shifted to the rich side. Conversely, if the lean delay time (−TDL) is set larger or the rich delay time TDR is set smaller, the control air-fuel ratio can be shifted to the lean side.

Furthermore, increase of the comparison voltage VR1 allows a shift of the control air-fuel ratio to the rich side. Reduction of the comparison voltage VR1 allows a shift of the control air-fuel ratio to the lean side.

Figure 7:
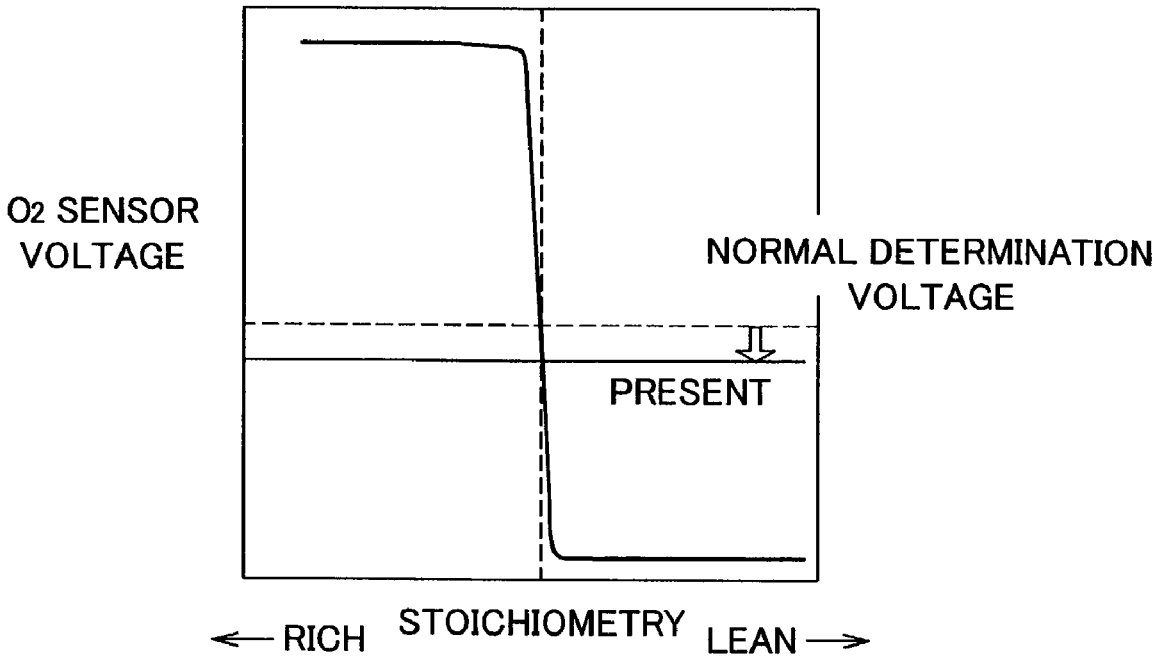
FIG. 7 is a diagram illustrating a lean feedback control based on the changing of the output voltage of the $O_2$ sensor.
Figures 8A, 8B, 8C, 8D:
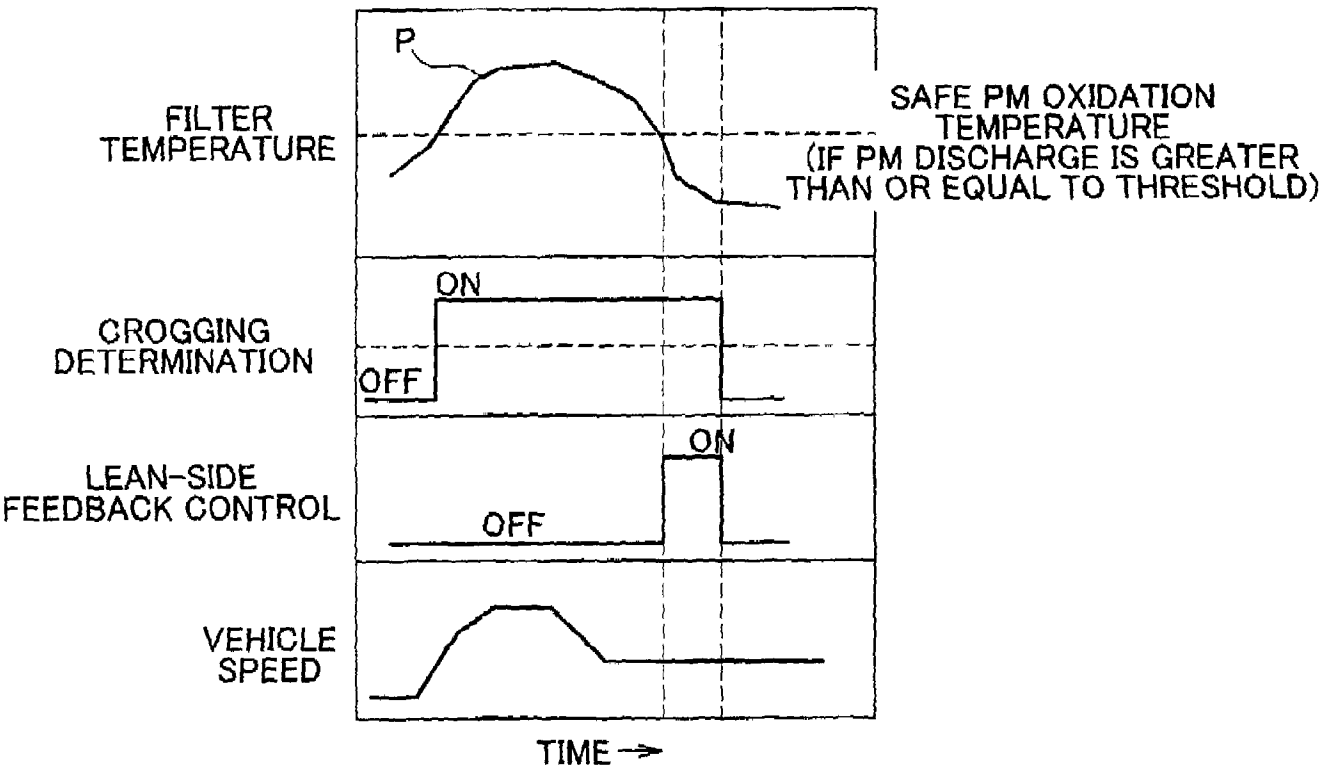
FIGS. 8A to 8D are diagrams illustrating the lean feedback control that is executed if the filter temperature drops to or below a safe oxidation temperature of particulate matter.

In this invention, a center air-fuel ratio needs to be on the lean side. As is apparent from the foregoing description, the center air-fuel ratio can be set toward a lean side by any one or combination of:

(1) to-lean side skip constant RSL>to-rich side skip constant RSR;

(2) to-lean side integral constant KIL>to-rich side integral constant KIR;

(3) rich determination delay time TDR<lean determination delay time TDL (whereby a lean state can be maintained for a long time);

(4) the lean/rich determination voltage of the $O_2$ sensor is reduced from the level set for the stoichiometric feedback control (FIG. 7) (if the determination voltage is reduced below the level for the stoichiometric feedback control, the determination that the air-fuel ratio is rich of stoichiometry is more frequently made, so that the time of lean correction becomes long and the center air-fuel ratio tends to be lean of stoichiometry).

Normally in the above-described internal combustion engine, the stoichiometric feedback control is performed by the first air-fuel ratio control means. However, if particulate matter has deposited on the filter, or is expected to deposit on the filter, or if the speed of oxidation of particulate matter has decreased, or is expected to decrease, the lean feedback control is performed by setting an air-fuel ratio correction factor FAF2 so as to shift the air-fuel ratio to the lean side, or by changing the skip constants RSL, RSR, the integral constants KIL, KIR or the delay times TDR, TDL used in the stoichiometric feedback control so as to satisfy the aforementioned condition (1) to (3), or by reducing the lean/rich determination voltage of the $O_2$ sensor from the level set for the stoichiometric feedback control as in the condition (4).

This lean feedback control is performed if particulate matter has deposited on the filter, or is expected to deposit on the filter, or if the speed of oxidation of particulate matter has decreased, or is expected to decrease. More specifically, the lean feedback control is performed under conditions as follows.

a) If it is determined that the speed of oxidation of particulate, matter is about to decrease, the feedback control is set toward the lean side by a technique described above.

EXAMPLE 1 OF DETERMINATION

Maps of discharge of particulate matter from the internal combustion engine under various operation conditions are prepared. The aforementioned determination is made if a region of a map is entered (if the amount of particulate matter increases so that the oxidation process does not keep up with the deposition of particulate matter). (This is an example of deposition state detecting means for detecting the state of deposition of particulate matter.)

EXAMPLE 2 OF DETERMINATION

The aforementioned determination is made if a particulate matter detection sensor disposed in the exhaust system detects a value that is greater than or equal to a threshold. (This is an example of the deposition state detecting means for detecting the state of deposition of particulate matter.)

EXAMPLE 3 OF DETERMINATION

The aforementioned determination is made if the filter temperature (temperature determined from an estimation map, or actually measured temperature) is low.

EXAMPLE 4 OF DETERMINATION

The aforementioned determination is made if it is determined that the particulate matter oxidation speed is low, by considering the particulate matter oxidation speed from the amount of particulate matter discharged and the temperature. It is determined that the particulate matter oxidation speed is low as the amount of particulate matter discharged increases, and as the temperature decreases.

b) If a clogged state of a particulate matter filter is detected, the feedback control is set toward the lean side by a technique described above.

EXAMPLE 1 OF DETECTION OF CLOGGING

The aforementioned determination is made if a pressure sensor detects a pressure rise above a threshold.

EXAMPLE 2 OF DETECTION

The aforementioned determination is made if the degree of decrease in the amount of intake air exceeds a threshold.

EXAMPLE 3 OF DETECTION

The aforementioned determination is made if an amount of deposit of particulate matter greater than or equal to a certain level is expected based on a particulate matter deposit amount estimating logic.

(These are examples of the deposition state detection means for detecting the state of deposition of particulate matter.)

However, if in the situation b), the filter temperature is higher than or equal to a temperature of safe oxidation speed of particulate matter, it is desirable to change the stoichiometric feedback control toward the lean side after the filter temperature drops to or below the safety temperature. Referring to FIGS. 8A to 8D, if the lean feedback control is performed at a point P in FIG. 8A, there is a danger of the filter temperature rising sharply to an overheat state and therefore damaging the catalyst. Therefore, a safety temperature for avoiding the danger is set as a threshold at, for example, about 500° C. The lean feedback control is performed at the time point when the filter temperature decreases to or below the threshold temperature.

In a system where the stoichiometric feedback control is changed toward the lean side, it is possible to minimize the emission of NOx not only in the case b), but in a case where the stoichiometric feedback control is changed toward the lean side via the storage-reduction function provided on the filter.

Furthermore, in a system where the stoichiometric feedback control is changed toward the lean side, it is appropriate to provide increased amounts of rhodium and other metals supported on the filter so that the reduction removal of NOx can be more effectively performed even if the feedback control is changed toward the lean side.

c) The feedback control is changed toward the lean side by a technique as described above, if under a condition where particulate matter is present in a relatively great amount and likely deposits as in a cold startup or the like, the stoichiometric feedback control is being performed and it is determined that the filter has been activated.

At the time of cold startup, the amount of particulate matter produced is great. Furthermore, the temperature of the $O_2$ sensor is low so that detection of $O_2$ is impossible. Therefore, the engine is operated through an open-loop control. Hence, during the subsequent operation, the feedback is controlled to the lean side on the condition that the stoichiometric feedback control condition is met (the $O_2$ sensor is activated) and therefore the stoichiometric feedback control is started, and that the filter is activated.

Therefore, a large amount of oxygen is supplied to the activated filter, so that oxidation of particulate matter can be improved. The amount of particulate matter discharged may be computed through integration based on a particulate matter sensor disposed in the exhaust pipe. The determination regarding activation of the filter is based on a value of filter temperature detected by a temperature sensor, or the engine operation condition. For example, if the filter temperature is higher than or equal to the activation temperature, or if a predetermined time has elapsed following startup of the engine, it is determined that the filter has activated.

Figures 9A, 9B, 9C:
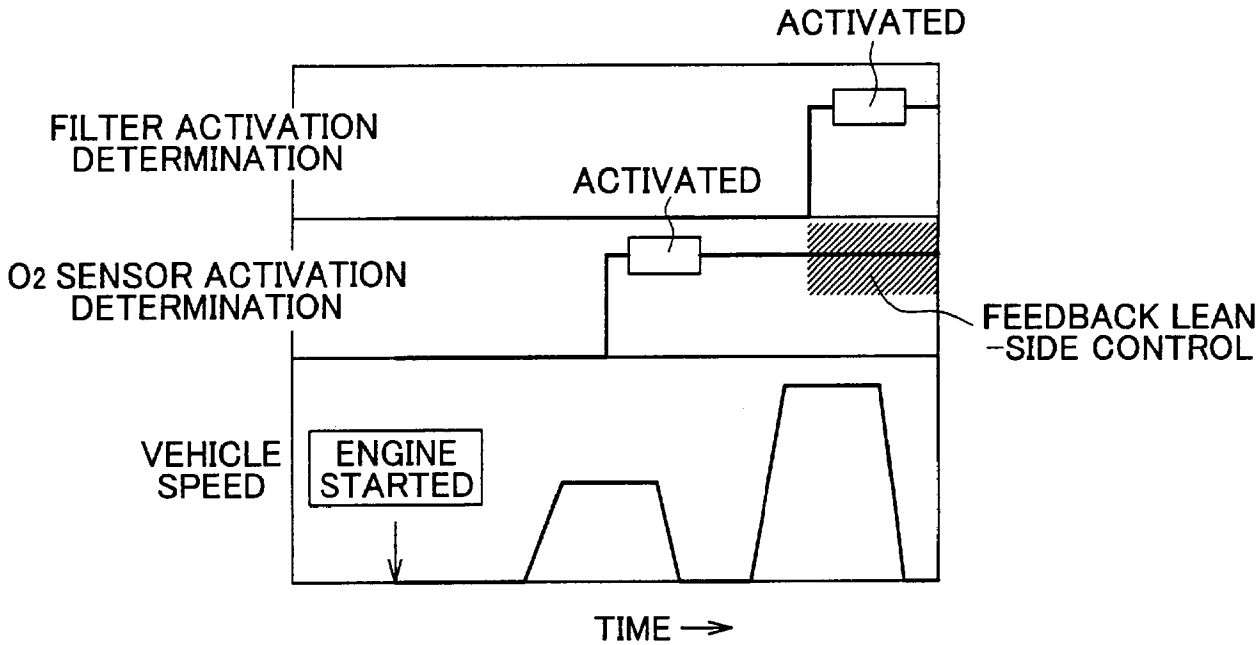
FIGS. 9A to 9C are diagrams illustrating a lean feedback control example 1 corresponding to production of particulate matter at the time of cold engine startup.
Figures 10A, 10B, 10C, 10D:
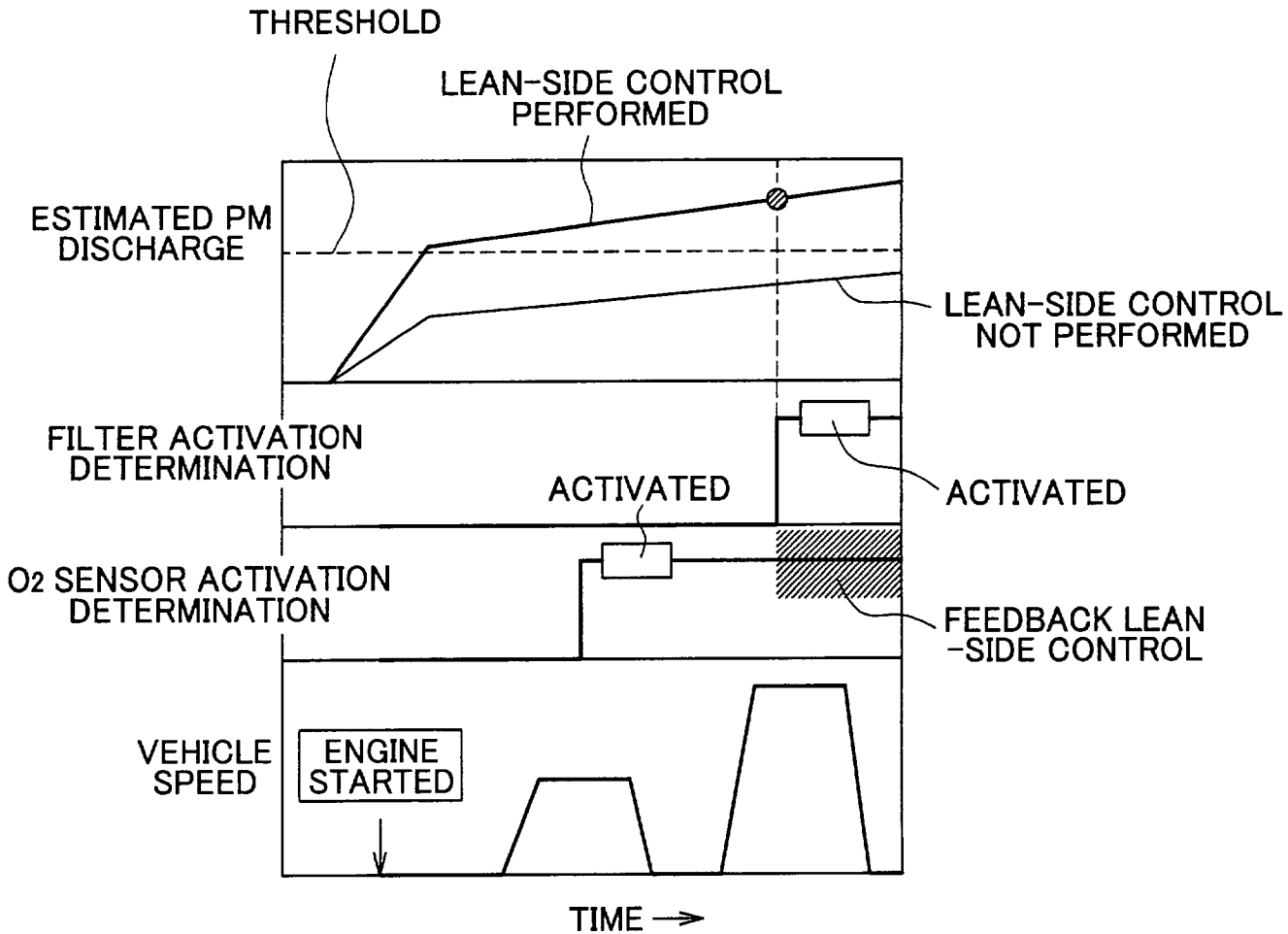
FIGS. 10A to 10C are diagrams illustrating a lean feedback control example 2 corresponding to production of particulate matter at the time of cold engine startup.

FIGS. 9A to 9C show timing charts of the aforementioned process. In this embodiment, the filter activation determination (FIG. 9A), the $O_2$ sensor activation determination (FIG. 9B) and the vehicle speed (FIG. 9C) are simultaneously monitored. After the engine is started, a predetermined temperature is reached, and the $O_2$ sensor activates. After that, the lean feedback control is performed on condition that the engine rotation speed rises and the filter temperature rises so that the activation is achieved.

FIGS. 10A to 10D indicate a case where the amount of particulate matter discharged is predicted from water temperature or oil temperature conditions (via a map or the like), and where if the predicted amount is greater than or equal to a predetermined value, the lean feedback control is performed.

d) The feedback control is changed to the lean side by a technique as described above if, after high-load operation that causes discharge of large amount of particulate matter, the stoichiometric feedback control is started and it is determined that the filter has activated.

During high-load operation, a rich operation is performed based on an open-loop control in order to secure output or protect the catalyst. Therefore, a lean-side operation cannot be performed by feedback. Therefore, after high-load operation that causes discharge of large amount of particulate matter, the lean feedback control is performed on the condition that the stoichiometric feedback control has been started, and that the filter has activated.

In this case, if there is a danger of thermal degradation being caused by a lean operation, the feedback control is changed to the lean side by a technique as described above on the condition that temperature is lower than or equal to a degradation determination temperature (700 to 800° C.).

Figures 11A, 11B:
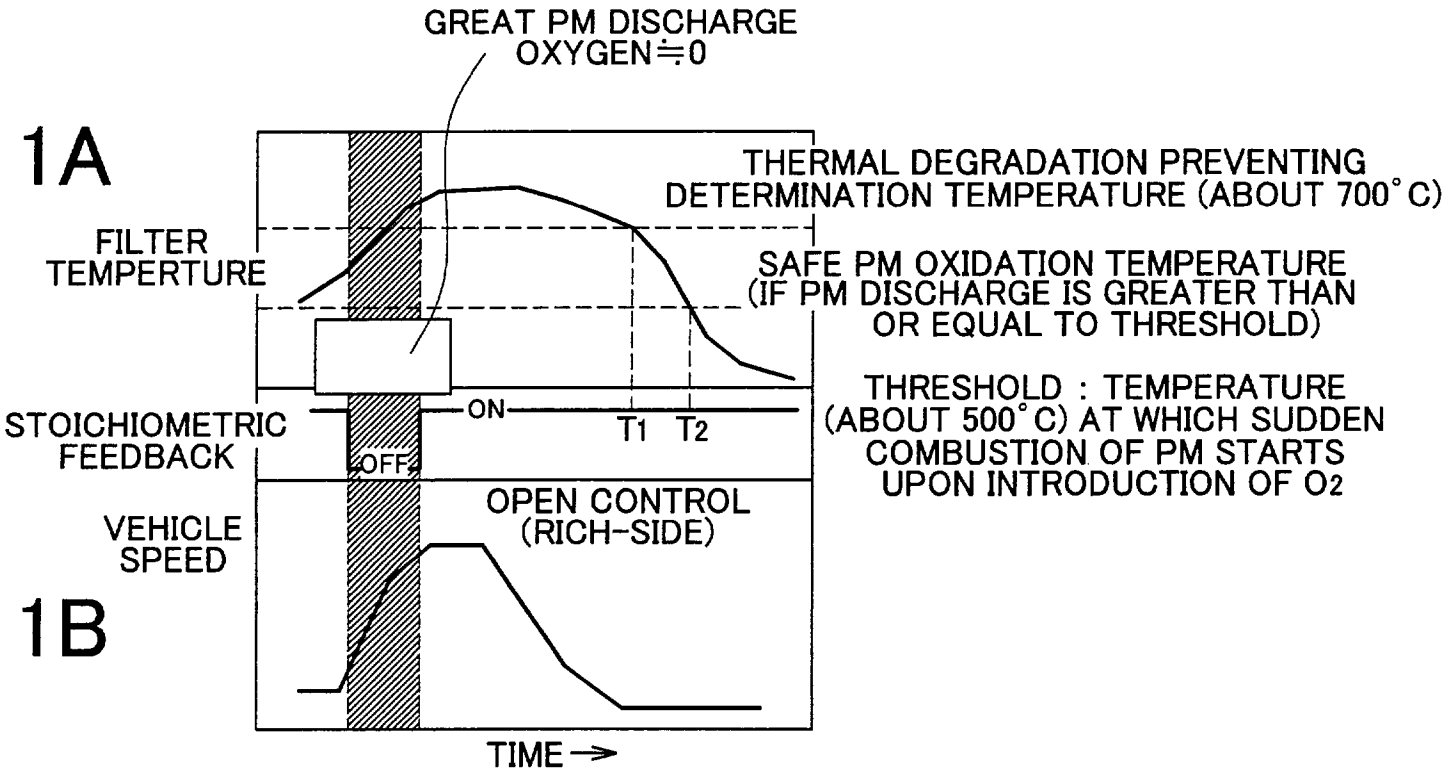
FIG. 11 is a diagram illustrating a lean feedback control example corresponding to production of particulate matter at the time of high-load operation.

This control is illustrated in FIGS. 11A and 11B. At the time of high-load operation due to rapid acceleration, the vehicle speed increases, and the open-loop control is entered. In this case, generation of particulate matter is great, and the oxygen concentration in exhaust gas becomes substantially zero. After the vehicle speed becomes stable, the control returns to the feedback control, so that it becomes possible to supply oxygen to the filter through the lean feedback control. However, if due to the temperature increase after rapid acceleration, the filter is overheated so that it is determined that there is a danger of thermal degradation being caused by further heating as a result of the lean feedback control (determined based on the filter temperature), the lean feedback control is performed on the condition (T1) that the filter temperature has dropped to or below a thermal degradation preventing determination temperature (700 to 800° C.).

Furthermore, if the amount of particulate matter discharged is greater than or equal to a predetermined value, there is a fear of excessive temperature rise due to combustion of particulate matter. In that case, therefore, the feedback control is changed to the lean side by a technique as described above on the condition (T2) that temperature has dropped to a safe particulate matter oxidation temperature (e.g., about 600° C.).

e) If it is determined that a certain amount of oxygen has been supplied in accordance with the amount of particulate matter discharged, the lean feedback control is stopped.

Examples are a case where as the amount of particulate matter discharged increases, the lean feedback control time is increased, a case where the amount of $O_2$ supplied is integrated based on the output of the $O_2$ sensor, and the lean feedback control is stopped if it is determined that an amount of $O_2$ corresponding to the amount of deposit of particulate matter has been supplied, a case where the amount of $O_2$ supplied is integrated based on the air-fuel ratio correction factor, and the lean feedback control is stopped if an amount of $O_2$ corresponding to the amount of deposit of particulate matter can be supplied, etc.

According to this embodiment, in a case where it is determined that the particulate matter oxidation speed has decreased, or a case where particulate matter has deposited, etc., oxygen is supplied to the exhaust gas control device through the lean feedback control, so that the particulate matter can be removed by burning. Particularly in a gasoline direct-injection engine, stratified lean-burn operation causes low exhaust gas temperature and relatively great amount of particulate matter discharged. Therefore, if the stratified lean-burn operation of the gasoline direct-injection engine is continued, there is a danger of deposition of particulate matter, according to the conventional art. However, the embodiment is able to smoothly perform the particulate matter oxidation process in this type of engine.

While the invention has been described with reference to what are presently considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the invention.

What is claimed is:

1. An exhaust gas control method for an internal combustion engine including an exhaust gas control device, provided in an exhaust passage of the internal combustion engine, that oxidizes particulate matter produced in conjunction with combustion of gasoline in a combustion chamber of the internal combustion engine, the method comprising the step of:

changing between first air-fuel ratio control that performs a feedback control toward a stoichiometric air-fuel ratio whereby an amount of oxygen in exhaust gas is reduced and second air-fuel ratio control that performs a feedback control toward a lean-burn combustion side whereby the amount of oxygen in exhaust gas is increased, wherein the first air-fuel ratio control normally performs the feedback control toward the stoichiometric air-fuel ratio and a change to the second air-fuel ratio control is performed if a predetermined condition relative to a state of particulate matter in the exhaust gas control device is met.

2. An exhaust gas control method for an internal combustion engine including an exhaust gas control device, provided in an exhaust passage of the internal combustion engine, that oxidizes particulate matter produced in conjunction with combustion of gasoline in a combustion chamber of the internal combustion engine, and an oxygen concentration sensor provided in the exhaust passage, the method comprising the step of:

feedback-controlling an air-fuel ratio to a predetermined target value based on an output of the oxygen concentration sensor;

performing normally, in principle, a stoichiometric feedback control with the target value being set at a stoichiometric air-fuel ratio, and changing the control to a lean feedback control in which an amount of fuel is made small relatively to the stoichiometric air-fuel ratio, if a predetermined condition relative to a state of particulate matter in the exhaust gas control device is met.

3. An internal combustion engine comprising:

an exhaust gas control device, provided in an exhaust passage, that oxidizes particulate matter produced in conjunction with combustion of gasoline in a combustion chamber of the internal combustion engine;

a first air-fuel ratio controller that performs a feedback control toward a stoichiometric air-fuel ratio whereby an amount of oxygen in exhaust gas is reduced;

a second air-fuel ratio controller that performs a feedback control toward a lean-burn combustion side whereby the amount of oxygen in exhaust gas is increased; and an air-fuel ratio control changer that changes between the first air-fuel ratio controller and the second air-fuel ratio controller, wherein the first air-fuel ratio controller normally performs the feedback control toward the stoichiometric air-fuel ratio and the air-fuel ratio control changer changes to the second air-fuel ratio controller if a predetermined condition relative to a state of particulate matter in the exhaust gas control device is met.

4. The exhaust gas control device-equipped internal combustion engine according to claim 3, wherein the exhaust gas control device includes at least one of a filter device in which a filter adapted for oxidizing and removing particulate matter is loaded with a NOx absorber (active oxygen releaser), a filter device loaded with an oxidation catalyst, and a filter device in which a filter not loaded with a catalyst is provided, and a catalyst for oxidation of NO into $NO_2$ is disposed upstream of the filter, and in which particulate matter is oxidized by $NO_2$.

5. The exhaust gas control device-equipped internal combustion engine according to claim 3, wherein the feedback control is changed to the lean feedback control performed by the second air-fuel ratio controller, if an operation condition where an oxidation speed of particulate matter decreases is assumed.

6. The exhaust gas control device-equipped internal combustion engine according to claim 3, further comprising a deposit state detector that detects a state of deposition of particulate matter, wherein if an amount of particulate matter deposited reaches at least a predetermined amount, the feedback control is changed to the lean feedback control performed by the second air-fuel ratio controller.

7. The exhaust gas control device-equipped internal combustion engine according to claim 3, wherein if a temperature of the exhaust gas control device is at least a predetermined value, the feedback control is changed to the lean feedback control performed by the second air-fuel ratio controller after the temperature decreases.

8. The exhaust gas control device-equipped internal combustion engine according to claim 3, wherein during a high-load engine operation, an open-loop control of the air-fuel ratio is performed, and that at a transition from this control state to a feedback control, the control is changed from the open-loop control to the lean feedback control.

9. The exhaust gas control device-equipped internal combustion engine according to claim 3, wherein the feedback control is returned from the lean feedback control to the stoichiometric feedback control if a predetermined amount of oxygen has been supplied to the exhaust gas control device.

10. The exhaust gas control device-equipped internal combustion engine according to claim 3, wherein during a cold engine start, the internal combustion engine is operated through an open-loop control of the air-fuel ratio, and after that, the control is changed to the lean feedback control.

11. The exhaust gas control device-equipped internal combustion engine according to claim 10, wherein during a cold engine start, a stoichiometric feedback control is performed provided that a feedback control starting condition is met, and after that, the feedback control is changed to the lean feedback control when the exhaust gas control device reaches an activation temperature.

12. An internal combustion engine comprising:

an exhaust gas control device, provided in an exhaust passage, that oxidizes particulate matter produced in conjunction with combustion of gasoline in a combustion chamber of the internal combustion engine;

an oxygen concentration sensor provided in the exhaust passage;

a first air-fuel ratio controller that performs a stoichiometric feedback control with the target value being set at a stoichiometric air-fuel ratio;

a second air-fuel ratio controller that performs a lean feedback control in which an amount of fuel is made small relatively to the stoichiometric air-fuel ratio; and an air-fuel ratio control changer that normally performs, in principle, the control by the first air-fuel ratio controller, and changes the feedback control to the control by the second air-fuel ratio controller if a predetermined condition relative to a state of particulate matter in the exhaust gas control device is met.

13. The exhaust gas control device-equipped internal combustion engine according to claim 12, wherein the exhaust gas control device includes at least one of a filter device in which a filter capable of oxidizing and removing particulate matter is loaded with a NOx absorber (active oxygen releaser), a filter device loaded with an oxidation catalyst, and a filter device in which a filter not loaded with a catalyst is provided, and a catalyst for oxidation of NO into $NO_2$ is disposed upstream of the filter, and in which particulate matter is oxidized by $NO_2$.

14. The exhaust gas control device-equipped internal combustion engine according to claim 12, wherein the feedback control is changed to the lean feedback control performed by the second air-fuel ratio controller, if an operation condition where an oxidation speed of particulate matter decreases is assumed.

15. The exhaust gas control device-equipped internal combustion engine according to claim 12, further comprising a deposit state detector that detects a state of deposition of particulate matter, wherein if an amount of particulate matter deposited reaches at least a predetermined amount, the feedback control is changed to the lean feedback control performed by the second air-fuel ratio controller.

16. The exhaust gas control device-equipped internal combustion engine according to claim 12, wherein if a temperature of the exhaust gas control device is at least a predetermined value, the feedback control is changed to the lean feedback control performed by the second air-fuel ratio controller after the temperature decreases.

17. The exhaust gas control device-equipped internal combustion engine according to claim 12, wherein during a high-load engine operation, an open-loop control of the air-fuel ratio is performed, and that at a transition from this control state to a feedback control, the control is changed from the open-loop control to the lean feedback control.

18. The exhaust gas control device-equipped internal combustion engine according to claim 12, wherein the feedback control is returned from the lean feedback control to the stoichiometric feedback control if a predetermined amount of oxygen has been supplied to the exhaust gas control device.

19. The exhaust gas control device-equipped internal combustion engine according to claim 12, wherein during a cold engine start, the internal combustion engine is operated through an open-loop control of the air-fuel ratio, and after that, the control is changed to the lean feedback control.

20. The exhaust gas control device-equipped internal combustion engine according to claim 19, wherein during a cold engine start, a stoichiometric feedback control is performed provided that a feedback control starting condition is met, and after that, the feedback control is changed to the lean feedback control when the exhaust gas control device reaches an activation temperature.

* * * * *